US005674167A

United States Patent [19]

Piaget et al.

[11] Patent Number: 5,674,167

[45] Date of Patent: Oct. 7, 1997

[54] STRENGTH TRAINING EXERCISE APPARATUS WITH ELASTOMERIC RESISTANCE MEMBERS

[75] Inventors: Gary D. Piaget; Trace O. Gordon, both of Park City, Utah; Mark R. Nestande, Chaska, Minn.; Paul M. Theisen, Shakopee, Minn.; John E. Titus, Prior Lake, Minn.; Ross A. Mackert, St. Louis Park, Minn.

[73] Assignee: Fitness Master, Inc., Waconia, Minn.

[21] Appl. No.: 546,923

[22] Filed: Oct. 23, 1995

[51] Int. Cl.[6] ..... A03B 21/02

[52] U.S. Cl. ..... 482/130; 482/138; 482/137

[58] Field of Search ..... 482/130, 138, 482/133, 134, 135, 129, 137

[56] References Cited

U.S. PATENT DOCUMENTS

| | | | |
|---|---|---|---|
| 418,257 | 12/1889 | Whitely . | |
| 4,848,741 | 7/1989 | Hermanson . | |
| 4,913,423 | 4/1990 | Farran et al. . | |
| 4,921,247 | 5/1990 | Sterling . | |
| 5,013,035 | 5/1991 | Nathaniel . | |
| 5,044,633 | 9/1991 | Rice . | |
| 5,090,694 | 2/1992 | Pauls et al. . | |
| 5,176,601 | 1/1993 | Reynolds | 482/130 |
| 5,195,937 | 3/1993 | Engel et al. . | |
| 5,234,394 | 8/1993 | Wilkinson . | |
| 5,324,243 | 6/1994 | Wilkinson . | |
| 5,348,524 | 9/1994 | Grant | 482/130 |
| 5,362,296 | 11/1994 | Wang et al. . | |

*Primary Examiner*—Lynne A. Reichard
*Attorney, Agent, or Firm*—Salter & Michaelson

[57] ABSTRACT

A strength training exercise apparatus includes a frame having an upright back rest, and a horizontal seat, and further includes opposing arm members pivotally mounted to the back rest. The arm members are movable through an arcuate range of motion, and include locking pins for selectively locking the arm members in desired angular positions. The apparatus still further includes a resistance assembly consisting of a fixed anchor mounted on the frame, a movable anchor which is movable relative to the fixed anchor, and a plurality of elastomeric resistance cords releasably secured between the movable anchor and the fixed anchor to provide resistance to movement of the movable anchor. A pull line is mounted on guide pulleys along the length of the arm members, and is received in association with the movable anchor whereby outward movement of the pull line with respect to the arm members causes movement of the movable anchor with respect to the fixed anchor. The exercise apparatus further consists of a leg member pivotally mounted to the seat, and a second resistance assembly including a second movable anchor coupled to the leg member, and a second plurality of elastomeric resistance cords secured between the fixed anchor and the second movable anchor for providing resistance to pivotal movement of the leg member.

10 Claims, 7 Drawing Sheets

STRENGTH TRAINING EXERCISE APPARATUS WITH ELASTOMERIC RESISTANCE MEMBERS

BACKGROUND AND SUMMARY OF THE INVENTION

The instant invention relates to exercise apparatus, and more particularly to a strength training exercise apparatus including elastomeric cord members which provide variable resistance to movement of various components of the apparatus.

Exercise devices which incorporate elastomeric elements or spring cables for providing resistance to movement have heretofore been known in the art. In this regard, the U.S. Patents to Wilkinson No. 418,257; Pauls et al No. 5,090,694; Wang et al No. 5,362,296; Sterling No. 4,921,247; Farran et al No. 4,913,423; Wilkinson No. 5,234,394; Nathaniel No. 5,013,035; and Hermanson No. 4,848,741 represent the closest prior art to the subject invention of which the applicant is aware. While the cited prior art devices are effective for their intended purpose, there is always a continuing need for new and improved exercise devices.

The instant invention provides a strength training exercise apparatus comprising a frame having a generally upright back rest portion, and a generally horizontal seat portion, and further comprising opposing arm members pivotally mounted to the back rest portion of the frame. The arm members are pivotally movable between a plurality of angular positions to provide a multitude of different exercise positions, and include locking pins for selectively locking the arm members in the desired angular positions. The apparatus further comprises a first resistance assembly comprising a fixed anchor mounted on the frame, a movable anchor which is movable relative to the fixed anchor, and a plurality of elastomeric resistance cords releasably securable between the movable anchor and the fixed anchor. A pull line is mounted on guide pulleys along the arm members and is further received in association with the movable anchor whereby outward movement of the pull line with respect to the arm members causes movement of the movable anchor with respect to the fixed anchor. Handle members are provided at the terminal ends of the pull line on each of the arm members for creating an outward movement of the pull line. In use, movement of the handles relative to the arm members causes relative movement of the movable anchor with respect to the fixed anchor, whereby the elastomeric cords provide resistance to the movement. One or more of the elastomeric cords may be utilized to provide different resistance levels during training thereby providing a highly versatile exercise apparatus The strength training apparatus still further comprises a single leg member pivotally mounted to the seat portion, and a second resistance assembly for providing independent resistance to movement of the leg member. The second resistance assembly comprises a second movable anchor coupled to the leg member by an inelastic member, and a second plurality of elastomeric resistance cords secured between the fixed anchor and the second movable anchor. In use, the operator engages his/her legs with the leg member in a manner appropriate for the desired exercise, wherein movement of the leg member during extension is resisted by the elastomeric cords. As with the arm members, one or more of the elastomeric cords can be utilized to provide different resistance levels.

For storage and portability, the leg member is movable to a storage position beneath the seat portion, and the seat and back rest portions are foldable to a generally parallel, overlying position.

Accordingly, among the objects of the instant invention are the provision of a highly versatile exercise device capable of performing many different exercises; the provision of an exercise device including adjustable arm members for exercising various body muscle groups; the provision of an exercise device including a leg extension member for exercising the leg muscle groups; the provision of an exercise device including a plurality of releasably mountable elastomeric resistance members for providing different resistance levels for various exercises offered; the provision of an exercise device which is compact, easy to use, and foldable for storage within the home; and the provision of an exercise device which is of high quality, yet nevertheless inexpensive to manufacture, and market.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
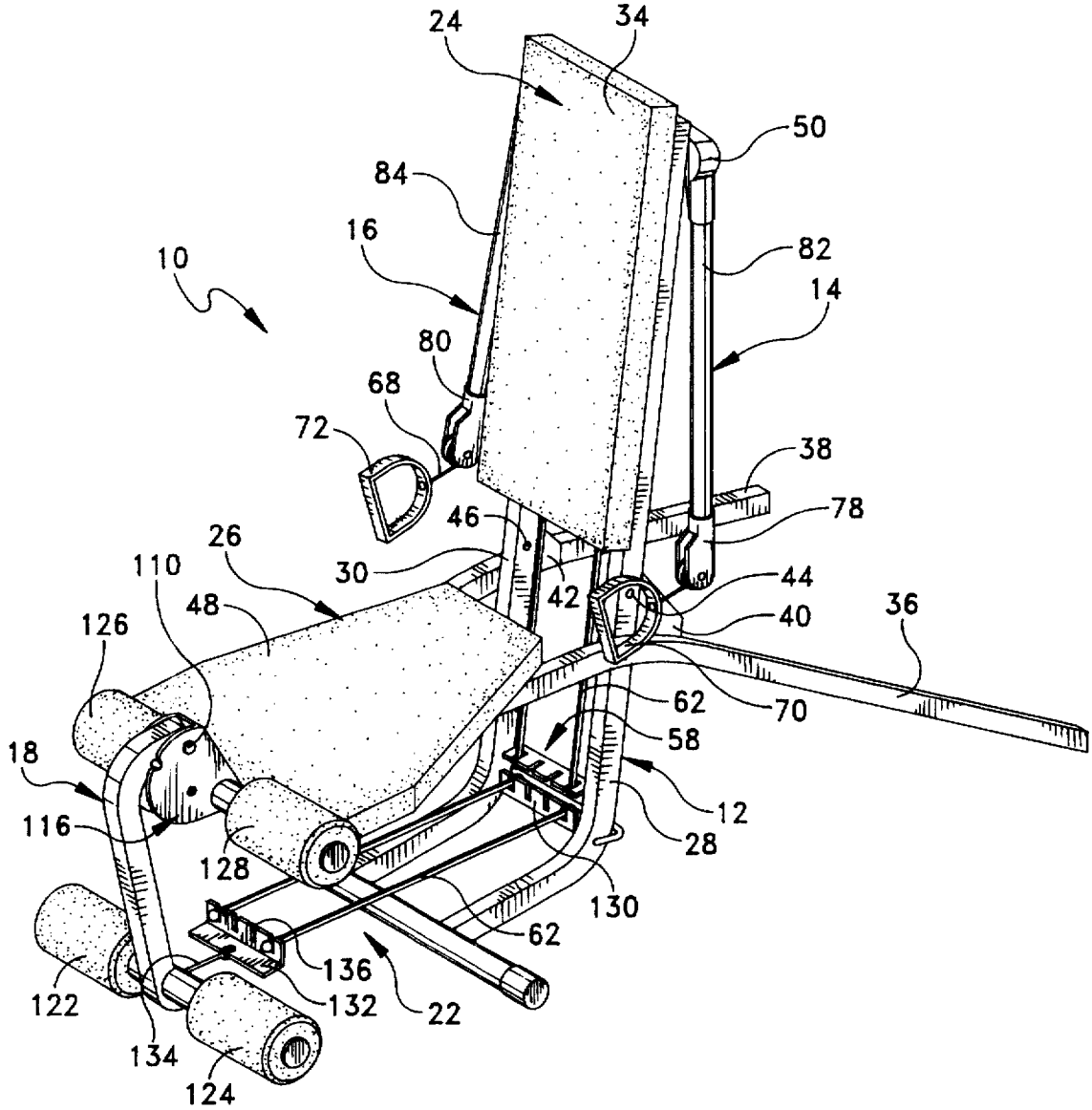
FIG. 1 is a perspective view of the strength training exercise apparatus of the instant invention.

Referring now to the drawings, the strength exercise apparatus of the instant invention is illustrated and generally indicated at 10 in FIGS. 1–8. As will hereinafter be more fully described, the instant strength training exercise apparatus 10 includes a plurality of elastomeric cords which provide variable resistance to movable leg and arm members.

The exercise apparatus 10 comprises a frame generally indicated at 12, first and second arm members generally indicated at 14, and 16 respectively, a leg member generally indicated at 18, and first and second independent resistance assemblies 20, and 22 respectively, for providing resistance to movement of the arm and leg members.

Figure 9:
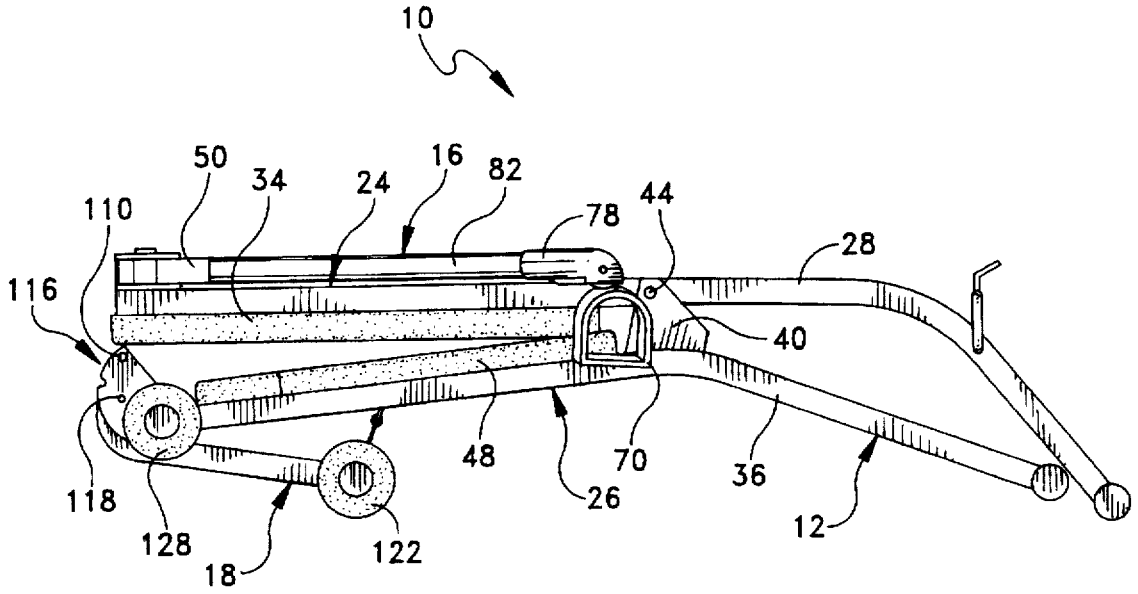
FIG. 9 is another side view of the exercise apparatus with the leg member, and the seat and back rest portions folded to their respective storage positions.

The frame 12 includes an upright back rest portion generally indicated at 24 and a seat portion generally indicated at 26. The back rest portion 24 comprises two spaced L-shaped legs 28, 30 respectively, and a cross member 32 affixed at the lower ends of the legs 28, 30. The cross member 32 engages the supporting surface (FIG. 2) for supporting the back rest portion 24. The back rest portion 24 further includes a padded panel 34 affixed to the upper portions of the legs 28, 30 for cushioning the back of an operator seated on the seat portion 26. The seat portion 26 comprises two spaced rails 36, 38 respectively, which are pivotally mounted to the legs 28, 30 of the back rest portion 24. More specifically, each of the rails 36, 38 includes a respective mounting plate 40, 42 which is pivotally affixed to the respective leg 28, 30 with a pin 44, 46. A padded panel 48 is affixed to the forward ends of the rails 36, 38 to provide a seating surface for the operator. The rear ends of the rails 36, 38 angle downwardly, and outwardly and engage the supporting surface. In use, the seat portion 26 and back rest portion 24 are pivotally movable between an open position (FIGS. 1 and 7) wherein the seat portion 26 and back rest portion 24 are disposed at an angle of about 120 degrees, and a closed position (FIG. 9) wherein the seat portion 26 and the back rest portion 24 are generally parallel in overlying relation, i.e. the padded panel 34 of the back rest portion 24 pivots downwardly to rest on top of the padded panel 48 of the seat portion 26. The various structural members of the frame 12 are preferably constructed of a tubular steel to provide strength and durability, and are preferably welded, where necessary, to provide necessary fixed joints therebetween. The padded panels 34, 48 are of conventional construction and will not be described further.

Figure 2:
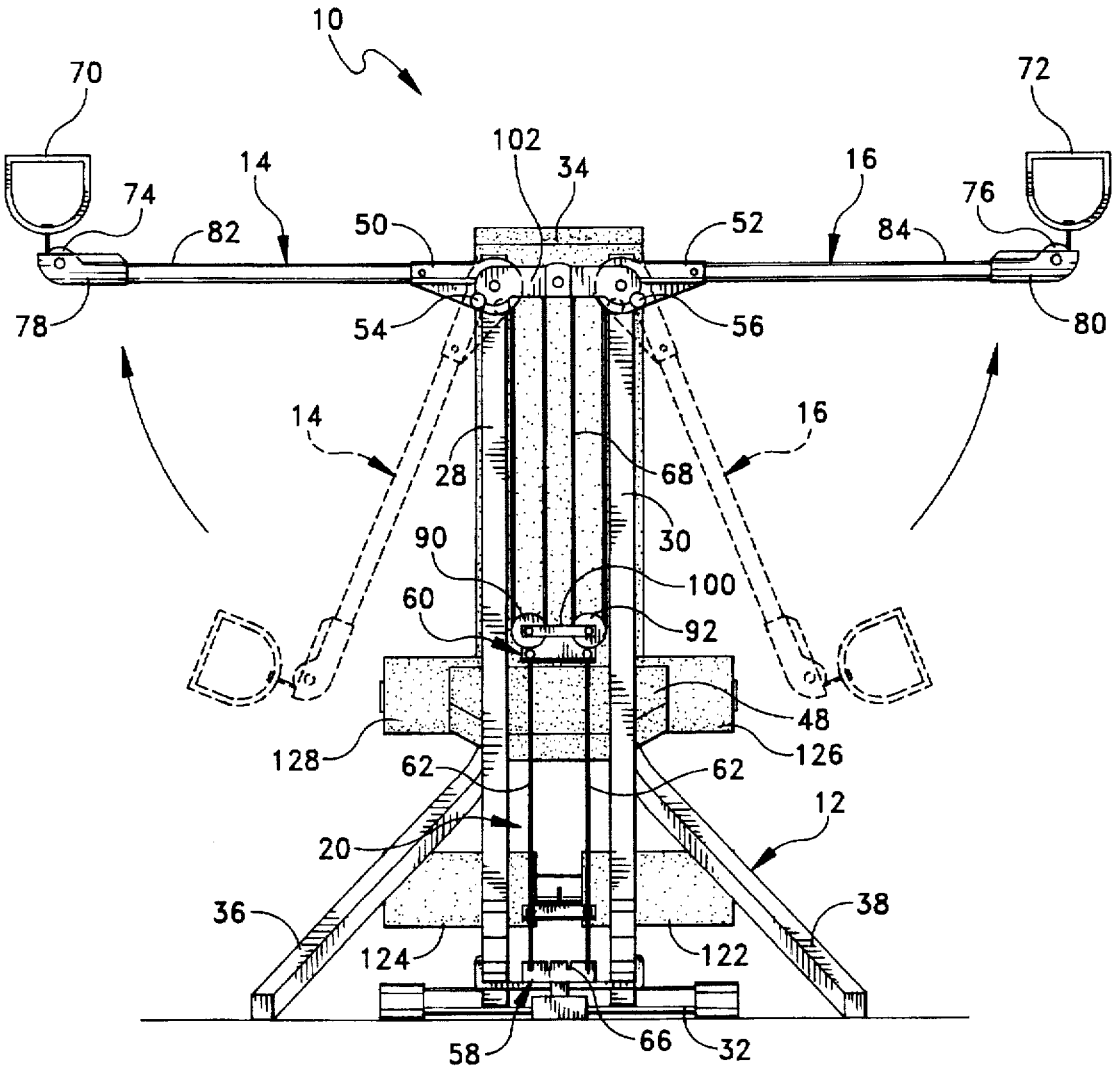
FIG. 2 is a rear view of the exercise apparatus showing pivoting movement of the arm members.
Figure 3:
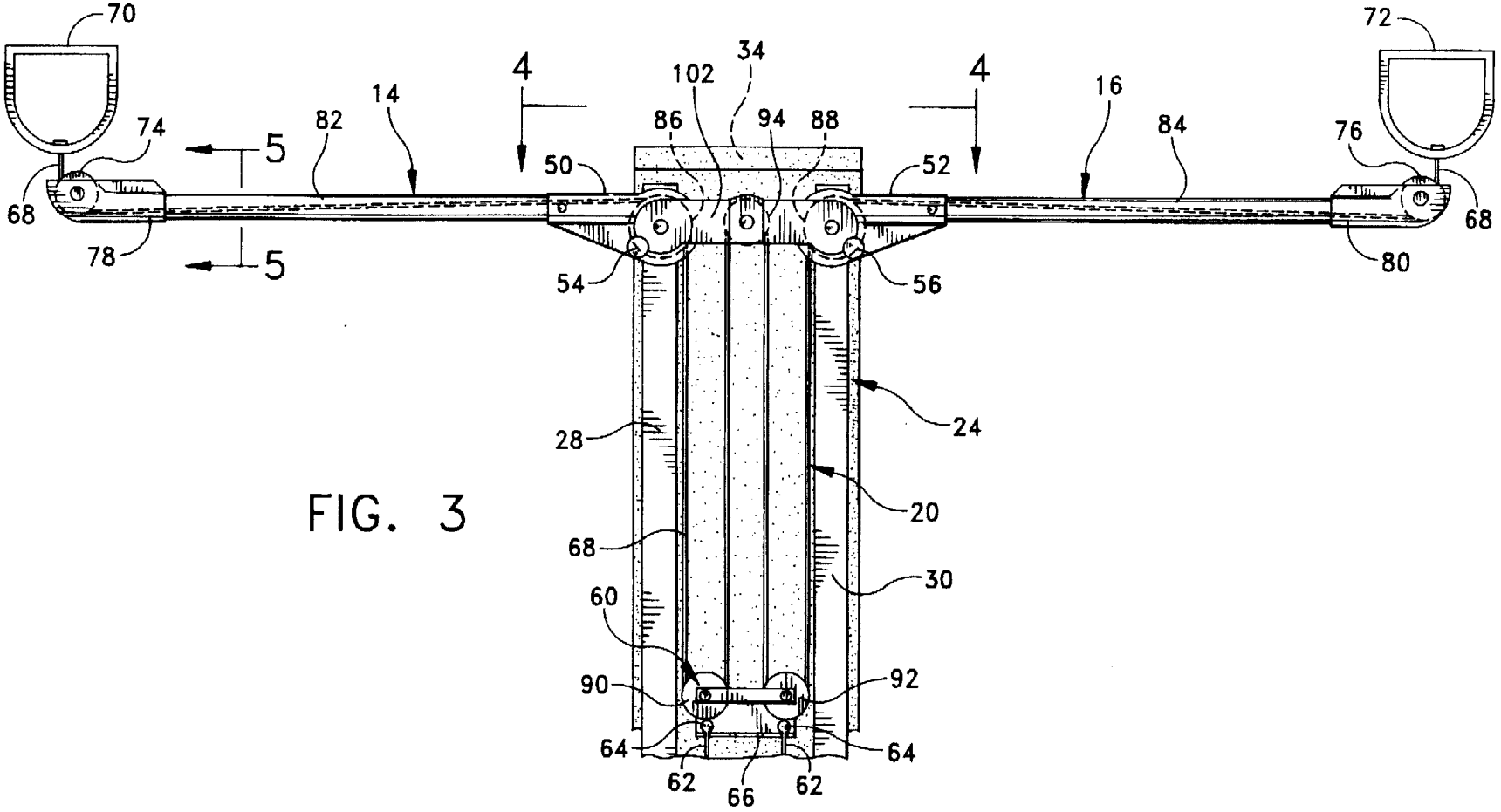
FIG. 3 is an enlarged rear view thereof showing the specific arrangement of the pull line and pulleys.
Figure 4:
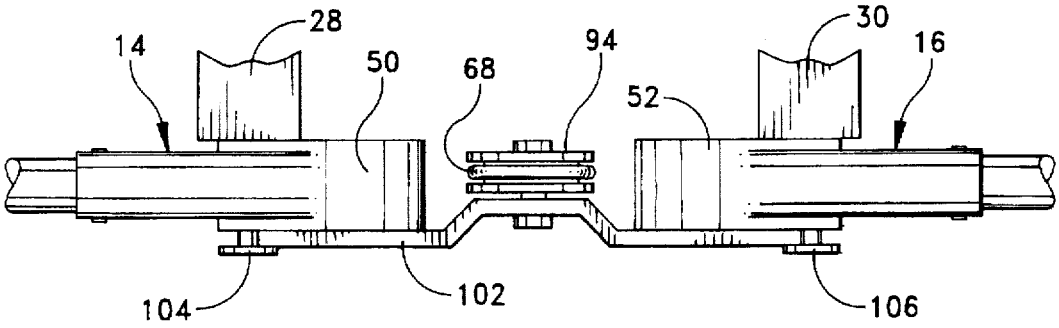
FIG. 4 is a cross-sectional view of the exercise apparatus taken along line 4—4 of FIG. 3.

The first and second arm members 14, 16 are pivotally mounted to the back rest portion 24 of the frame 12 such that they extend laterally outwardly from the back rest portion 24, and are pivotally movable through an arcuate range of motion. More specifically, respective first end portions 50, 52 of the arm members 14, 16 are pivotally mounted to an upper end section of the respective legs 28, 30 of the back rest portion 24, and they are movable in an arcuate range of motion between a first position (see broken lines FIG. 2), and a second position (see solid lines FIG. 2) wherein the arms 14, 16 are generally collinear. It is pointed out that the furthest downward position of the arm members 14, 16, as indicated in broken lines in FIG. 2, is still somewhat angled out to the sides, and that the arms 14, 16 do not fold behind the back rest portion 24 of the frame 12. Each of the arm members 14, 16 is provided with a spring-loaded pop-type locking pin 54, 56 on the respective first end portions 50, 52 for selectively locking the arm members 14, 16 in desired angular positions within the range of motion indicated. In this regard, the pop pins 54, 56 are received into corresponding apertures in locking plates (not shown) affixed to the legs 28, 30 of the back rest portion 24 of the frame 12. Accordingly, in use, the arm members 14, 16 can be selectively positioned in one of a plurality of different angular positions by extending the pop-pins 54, 56 through one of the apertures in the associated locking plate (not shown).

The first resistance assembly 20 comprises a fixed anchor generally indicated at 58 secured to the frame 12, a movable anchor generally indicated at 60 movable relative to the fixed anchor 58, and a plurality of extendable resistance members generally indicated at 62 secured between the fixed anchor 58 and the movable anchor 60. The extendable resistance members 62 preferably comprise an elastomeric cord, such as elastomeric rubber cord, which will deform under tension, and then contract, when released, to retain its original shape. The elastomeric cords 62 are preferably releasably mounted to the respective anchors 58, 60, and in this regard, the opposing ends of the elastomeric cords 62 each include an enlarged bulb 64 which is slidably received in engagement with an edge slot 66 formed in the respective anchor 58, 60. It is pointed out that each of the anchors 58, 60 includes four (4) slots 66 for the mounting of up to four elastomeric cords 62 during use. The use of one or more of the elastomeric cords 62 provides for four different levels of resistance. Although four slots have been disclosed, it is to be understood that more or fewer than four slots may be employed.

Figure 6:
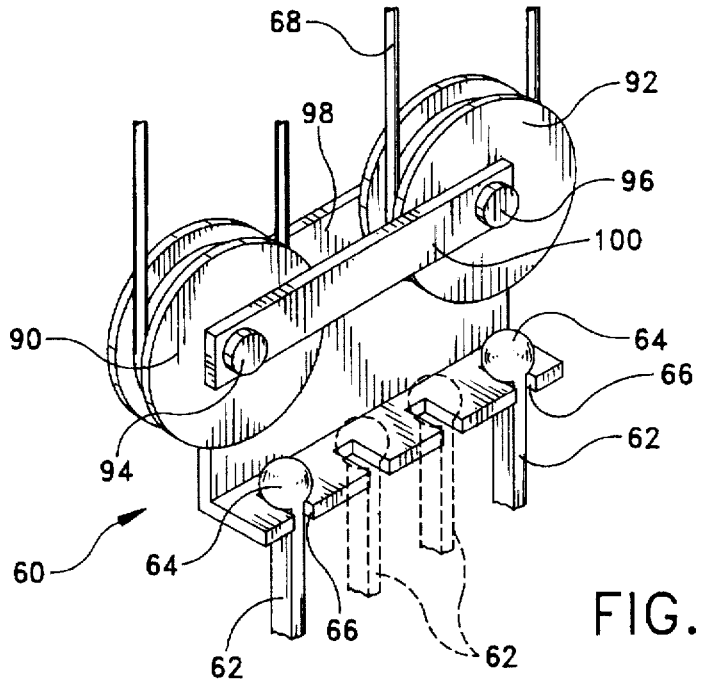
FIG. 6 is an enlarged, fragmentary perspective view of the movable anchor showing attachment of the elastomeric cords to the anchor.

Referring to FIG. 2, a single, preferably inelastic, pull line 68 is mounted on a plurality of guide pulleys along the length of the arm members 14, 16, and is further received in association with pulleys on the movable anchor 60, whereby outward movement of the pull line 68 with respect to the arm members 14, 16 causes movement of the movable anchor 60 relative to the fixed anchor 58. Respective handle members 70, 72 are provided at the terminal ends of the pull line 68 whereby the operator can grasp the respective handle 70, 72 for creating outward movement of the pull line 68. The respective ends of the pull line 68 pass over first pulleys 74, 76 mounted on pivotable end portions 78, 80 of the respective arm members 14, 16. The pull line 68 travels through respective center portions 82, 84 of the arm members 14, 16 and passes over pulleys 86, 88 (broken lines) respectively mounted at the pivot point of the respective arm member 14, 16. The pull line 68 then runs downwardly and around the two respective pulleys 90, 92 on the movable anchor 60, and upwardly in the center around a central pulley 94 to complete the loop. It can thus be appreciated that outward movement of the handles 70, 72 with respect to the arm members 14, 16, either simultaneously or independently, will cause upward movement of the movable anchor 60 away from the fixed anchor 58. Each of the pulleys is conventional in the art, and is mounted for rotation about a central axis. The two pulleys 90, 92 on the movable anchor 60 are mounted on pins 94, 96 (FIG. 6) which extend between a wall 98 of the anchor 60 and an outer bar 100 (FIG. 6). The central pulley 94 is mounted on a bar 102 which extends between the pivot pins 104, 106 of the arm members 14, 16.

Figure 5:
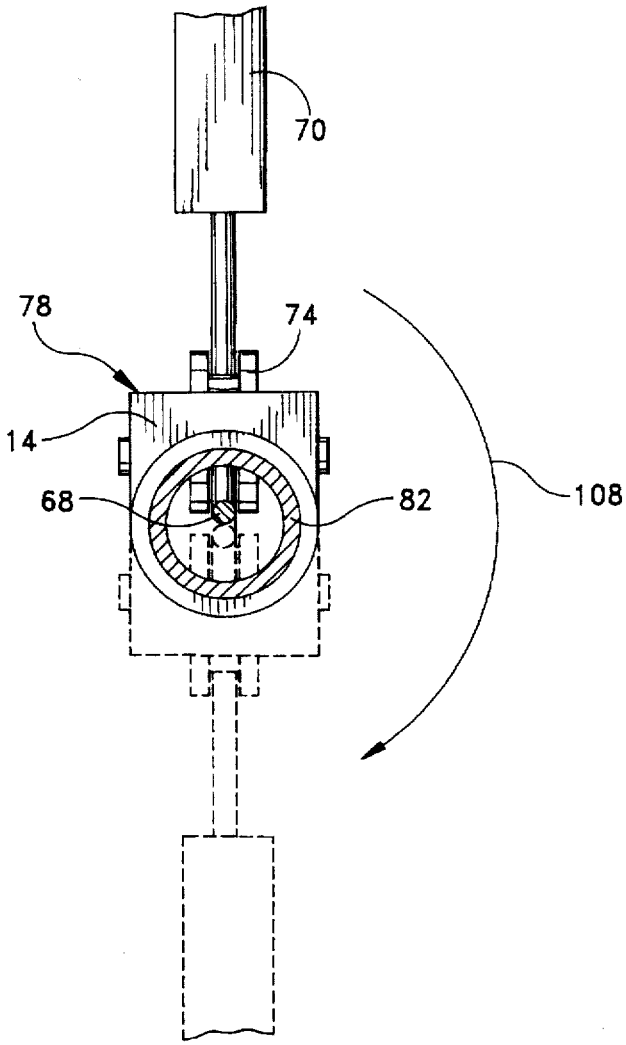
FIG. 5 is a cross-sectional view of the arm member taken along line 5—5 of FIG. 3.

Referring to FIG. 5, it is pointed out that the end portions 78, 80 of the arm members 14, 16 are rotatable (see arrow 108) with respect to the center portions 82, 84 whereby the pulleys 74, 76 are allowed to rotate and correctly orient themselves with respect to the direction in which the pull line 68 is being pulled.

As a representative use of the arm members 14,16 during an exemplary pectoral muscle exercise, an operator may sit on seat portion 26 with his/her back against the back rest portion 24. With the arm members 14,16 positioned at their uppermost position as illustrated in solid lines in FIG. 2, the operator would then grasp the handles 70, 72, and press the handles 70, 72 forwardly within a generally horizontal plane, thereby simulating a conventional bench press type exercise.

Figure 8:
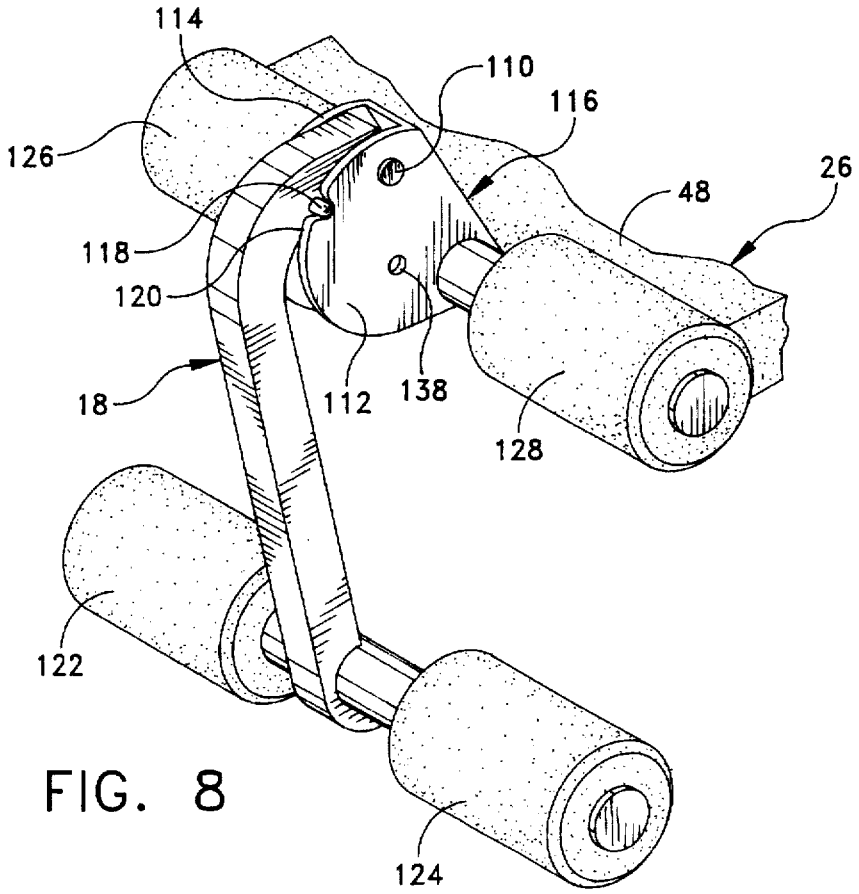
FIG. 8 is an enlarged, fragmentary perspective view of the leg member of the exercise apparatus.
Figure 7:
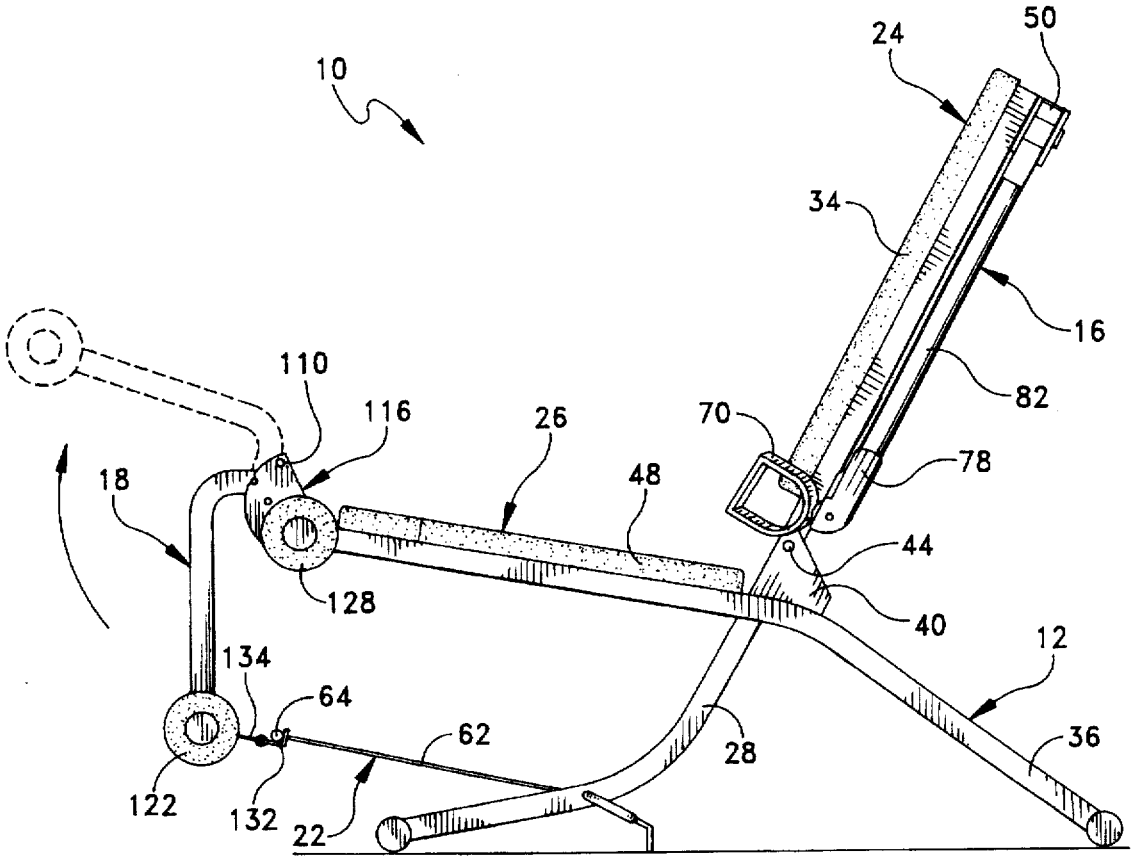
FIG. 7 is a side view of the exercise apparatus showing extension of the leg member during use thereof.

The leg member 18 is pivotally mounted at a first end thereof to the forward end of the seat portion 26, and is pivotally movable between a rest position (solid lines (FIG. 7) wherein the leg member 18 is generally perpendicular to the seat portion 26, and an extended position (broken lines FIG. 7) wherein the leg member 18 is generally parallel to the seat portion 26. More specifically, the pivotal mounting of the leg member 18 is accomplished by a pin 110 on the first end of the leg member 18 which is received through aligned apertures in facing plates 112, 114 of a channel member generally indicated at 116 (FIG. 8). The leg member 18 is held in the rest position by a spring pin 118 which engages with a notch 120 formed in plate 112. The second end of the leg member 18 is provided with opposing padded foot pegs 122, 124 for receiving the ankles of the operator. A second pair of padded pegs 126, 128 is provided adjacent the seat portion 26 for receiving the knees of the operator.

The second resistance assembly 22 comprises a second fixed anchor 130 mounted to the frame 12, a movable anchor 132 coupled to the second end of the leg member 18 by an inelastic line 134, and a plurality of extendable resistance members 62 received between the fixed anchor 130 and the movable anchor 132. It is pointed out that fixed anchors 58 and 130, respectively, are actually formed as a single anchor assembly affixed to the frame 12. The movable anchor 132 is movable with the leg member 18 during movement thereof between the rest position and the extended position whereby the resistance members 62 provide resistance to such movement. As described previously, the resistance members 62 comprise elastomeric cords having enlarged bulbs 63 at the ends thereof which are slidably received in engagement with edge slots 136 formed in the respective anchors 130, 132. As described in connection with use of the arm members 14, 16, one or more of the cords 62 may be utilized for providing different levels of resistance. The leg member 18 is further movable from the rest position to a storage position (FIG. 9) by depressing the spring-loaded pin 118 and rotating the leg member 18 to a position beneath the seat portion 26 wherein the leg member 18 is generally parallel to the padded panel 48. The leg member 18 is maintained in the storage position by the spring-loaded pin 118 which extends through corresponding aperture 138 formed in plate 112 (FIG. 8).

It can therefore be seen that the instant invention provides an effective strength training exercise apparatus 10 which is provides unparalleled portability, storage, and total body exercise versatility which have not been found before in the prior art. The unique frame assembly 12 quickly and easily folds for storage and similarly unfolds use. The unique elastomeric cords 62, easily attach and detach from their anchors for quick changes of resistance during use, while providing effective and efficient resistance to exercise movements. Use of different numbers of elastomeric cords 62 permits differing resistance levels for all exercises. The paired arm members 14, 16 securable in a plurality of different positions, along with the extendable leg member 18 permit a multitude of different exercises for strengthening all seven of the major muscle groups including legs, chest, back, shoulders, biceps, triceps and abdominals. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. An exercise apparatus comprising:

a frame including a generally upright back rest portion, and a generally horizontal seat portion;

an arm member including a first end pivotally mounted to said frame, and further including a distal second end, said arm member extending laterally from said back rest portion and being pivotally movable through an arcuate range of motion;

means for selectively locking said arm member in a predetermined angular position;

a fixed anchor on said frame;

a movable anchor movable relative to said fixed anchor;

resistance means secured between said fixed anchor and said movable anchor for providing resistance to movement of said movable anchor with respect to said fixed anchor;

line means mounted in association with said movable anchor for moving said movable anchor relative to said fixed anchor, said line means being mounted for guided movement along a longitudinal extent of said arm member whereby outward movement of said line means with respect to said arm member causes movement of said movable anchor with respect to said fixed anchor;

a leg member having a first end pivotally mounted to said frame, said leg member being pivotally movable between a rest position wherein said leg member is generally perpendicular to said seat portion, and an extended position wherein said leg member is generally parallel to said seat portion;

a second movable anchor coupled to a second end of said leg member for movement therewith; and a second resistance means secured between said fixed anchor and said second movable anchor for providing resistance to movement of said leg member from said rest position to said extended position.

2. The exercise apparatus of claim 1 wherein said leg member is further movable from said rest position to a storage position beneath said seat portion wherein said leg member is generally parallel to said seat portion, said apparatus further comprising means for locking said leg member in said storage position.

3. The exercise apparatus of claim 1 wherein each of said respective resistance means comprises an elastomeric cord having first and second ends respectively secured to said fixed anchor and said respective movable anchor.

4. The exercise apparatus of claim 3 wherein said first and second ends of said elastomeric cord are releasably secured to said fixed anchor and said respective movable anchor.

5. The exercise apparatus of claim 4 wherein said first and second ends of said elastomeric cord each include an enlarged end portion which is slidably received in engagement with an edge slot formed in said respective anchor.

6. An exercise apparatus comprising:

a frame including a generally upright back rest portion, and a generally horizontal seat portion;

first and second arm members each including a first end pivotally mounted to said frame, and a distal second end, said first and second arm members extending laterally from said back rest portion and being pivotally movable through an arcuate range of motion;

means for selectively locking said first and second arm members in a predetermined angular position;

a fixed anchor on said frame;

a movable anchor movable relative to said fixed anchor;

an extendable resistance member secured between said fixed anchor and said movable anchor;

line means mounted in association with said movable anchor for moving said movable anchor relative to said fixed anchor, said extendable resistance member providing resistance to movement of said movable anchor relative to said fixed anchor, said line means being mounted for guided movement along a longitudinal extent of said first and second arm members and having terminal end portions adjacent the distal second ends of said first and second arm members whereby outward movement of said line means with respect to one of said arm members causes movement of said movable anchor with respect to said fixed anchor;

a leg member having a first end pivotally mounted to said frame adjacent a forward end of said seat portion, said leg member being pivotally movable between a normal rest position wherein said leg member is generally perpendicular to said seat portion, and an extended position wherein said leg member is generally parallel to said seat portion;

a second movable anchor coupled to a second end of said leg member, said second movable anchor being movable with said leg member relative to said fixed anchor; and a second extendable resistance member secured between said fixed anchor and said second movable anchor for providing resistance to movement of said leg member from said rest position to said extended position.

7. The exercise apparatus of claim 6 wherein said leg member is further movable from said rest position to a storage position beneath said seat portion wherein said leg member is generally parallel to said seat portion, said apparatus further comprising means for locking said leg member in said storage position.

8. The exercise apparatus of claim 6 wherein each of said respective resistance members comprises an elastomeric cord having first and second ends respectively secured to said fixed anchor and said respective movable anchor.

9. The exercise apparatus of claim 8 wherein said first and second ends of said elastomeric cord are releasably secured to said fixed anchor and said respective movable anchor.

10. The exercise apparatus of claim 9 wherein said first and second ends of said elastomeric cord each include an enlarged end portion which is slidably received engagement with in an edge slot formed in said respective anchor.

* * * * *